US007946391B2

(12) United States Patent
von Holzen

(10) Patent No.: US 7,946,391 B2
(45) Date of Patent: May 24, 2011

(54) HYDRAULIC ELEVATOR WITHOUT MACHINE ROOM

(75) Inventor: Richard von Holzen, Menzingen (CH)

(73) Assignee: Bucher Hydraulics AG, Neuheim (DE)

( * ) Notice: Subject to any disclaimer, the term of this patent is extended or adjusted under 35 U.S.C. 154(b) by 707 days.

(21) Appl. No.: 11/922,535

(22) PCT Filed: Oct. 13, 2005

(86) PCT No.: PCT/CH2005/000600

§ 371 (c)(1),
(2), (4) Date: Dec. 19, 2007

(87) PCT Pub. No.: WO2007/009269

PCT Pub. Date: Jan. 25, 2007

(65) Prior Publication Data

US 2009/0114482 A1 May 7, 2009

(30) Foreign Application Priority Data

Jul. 19, 2005 (CH) ..... 1199/05

(51) Int. Cl.
*B66B 1/28* (2006.01)

(52) U.S. Cl. ..... 187/285; 187/272; 417/423.15

(58) Field of Classification Search ..... 187/285, 187/250, 272–275, 345–347, 253, 414; 417/423.15, 417/423.2, 423.3, 423.7, 423.8, 423.14; 91/418; 92/144

See application file for complete search history.

(56) References Cited

U.S. PATENT DOCUMENTS

| | | | | |
|---|---|---|---|---|
| 4,800,990 | A * | 1/1989 | Blain | 187/306 |
| 4,830,146 | A | 5/1989 | Nakamura et al. | |
| 5,443,140 | A * | 8/1995 | Nagel et al. | 187/253 |
| 5,522,479 | A * | 6/1996 | Jo | 187/275 |
| 5,593,004 | A * | 1/1997 | Blain | 187/275 |
| 6,029,448 | A * | 2/2000 | Hobson | 60/468 |
| 6,044,933 | A * | 4/2000 | Johansson et al. | 187/272 |
| 6,247,559 | B1 * | 6/2001 | Ach | 187/414 |
| 6,371,005 | B1 * | 4/2002 | Foschini et al. | 91/418 |
| 6,499,567 | B2 * | 12/2002 | Foschini et al. | 187/272 |
| 6,662,905 | B2 * | 12/2003 | Sors | 187/347 |
| 6,957,721 | B2 * | 10/2005 | Moser | 187/285 |

(Continued)

FOREIGN PATENT DOCUMENTS

EP 0 924 155 6/1999

(Continued)

*Primary Examiner* — Jonathan Salata

(74) *Attorney, Agent, or Firm* — Cohen Pontani Lieberman & Pavane LLP

(57) ABSTRACT

A hydraulic elevator for an elevator shaft having guide rails for an elevator cab. The hydraulic elevator has no machine room and includes an assembly disposed between the guide rails and a tank, a pump mounted in the tank, a motor mounted in the tank for driving the pump, and a control valve unit mounted on the tank and in working relationship with the pump. One of the pump and the motor is disposed above the other of the pump and the motor. The hydraulic elevator further includes a hydraulic drive mounted on the tank, the hydraulic drive being configured to move the elevator cab by a cable; and an emergency operating and monitoring device disposed outside of the elevator shaft and connectable to the control valve unit by a measuring line.

9 Claims, 2 Drawing Sheets

U.S. PATENT DOCUMENTS

| | | | | |
|---|---|---|---|---|
| 7,117,979 | B2 * | 10/2006 | Angst et al. | 187/351 |
| 7,134,528 | B2 * | 11/2006 | Birbaumer et al. | 187/285 |
| 2002/0029938 | A1 * | 3/2002 | Sors | 187/345 |
| 2009/0057067 | A1 * | 3/2009 | Boyd et al. | 187/253 |
| 2010/0012436 | A1 * | 1/2010 | Block et al. | 187/261 |

FOREIGN PATENT DOCUMENTS

| | | |
|---|---|---|
| EP | 1 081 083 | 3/2001 |
| EP | 1 437 321 | 7/2004 |
| JP | 04 169491 | 6/1992 |

* cited by examiner

HYDRAULIC ELEVATOR WITHOUT MACHINE ROOM

CROSS-REFERENCE TO RELATED APPLICATIONS

This is a U.S. national stage of International Application No. PCT/CH2005/000600, filed on 13 Oct. 2005. Priority is claimed on Switzerland Application No. 1199/05, filed on 19 Jul. 2005.

BACKGROUND OF THE INVENTION

1. Field of the Invention

The invention pertains to a hydraulic elevator without a machine room.

2. Description of the Related Art

Elevators of this type are used to advantage in residential and office buildings.

An elevator of the type mentioned above is known from EP 0 924 155 B1. Here, an assembly consisting of a pump and a tank is installed at the bottom of the elevator shaft between the guide rails of the elevator, whereas a valve block is installed outside the shaft. The hydraulic drive is mounted on a cross-beam above the pump/tank assembly.

A similar arrangement is known from WO 2003/013996 A1. The drive assembly with pump, tank, and valve unit is again located in the elevator shaft, but here it is installed next to the guide rails. The valve unit can be moved to various locations.

SUMMARY OF THE INVENTION

The invention is based on the task of creating a hydraulic elevator without a machine room in which the tank, the pump, and the valve unit form a single assembly which can be fabricated in the manufacturer's factory and which is so compact that the entire assembly can be accommodated between the guide rails of the cab in the elevator shaft.

The task indicated above is accomplished a hydraulic elevator for an elevator shaft having guide rails for an elevator cab, the hydraulic elevator having no machine room and including an assembly disposed between the guide rails and comprising a tank, a pump mounted in the tank, a motor mounted in the tank for driving the pump, and a control valve unit mounted on the tank and in working relationship with the pump. One of the pump and the motor is disposed above the other of the pump and the motor. The hydraulic elevator further includes a hydraulic drive mounted on the tank, the hydraulic drive being configured to move the elevator cab by a cable; and an emergency operating and monitoring device disposed outside of the elevator shaft and connectable to the control valve unit by a measuring line.

BRIEF DESCRIPTION OF THE DRAWINGS

An exemplary embodiment of the invention is explained in greater detail below on the basis of the drawing.

DETAILED DESCRIPTION OF THE PREFERRED EMBODIMENTS

Figure 1:
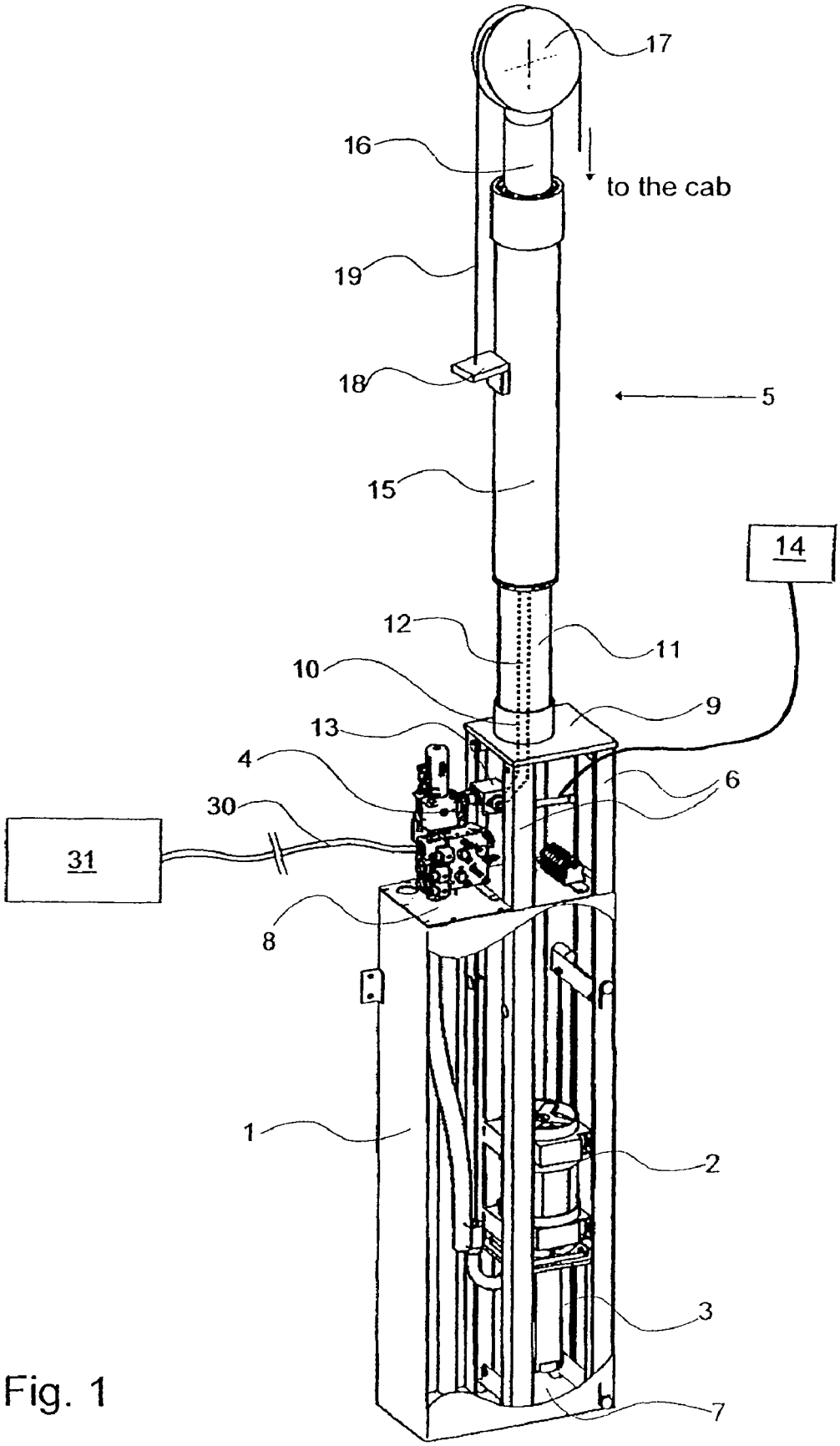
FIG. 1 shows a perspective view of a drive assembly.

FIG. 1 shows a drive assembly for a hydraulic elevator, which can be installed in the elevator shaft between the guide rails (not shown). It consists of a tank 1, in which a pump 3 and the motor 2 which drives the pump are installed vertically to save space. The vertical arrangement is significant, because hydraulic elevators are preferably used in smaller buildings with limited space, where in most cases only small elevator cabs capable of holding only a few passengers are provided. In elevators of this type, the distance between the guide rails and also the distance between the shaft wall and the cab are correspondingly small. A control valve unit 4 is mounted on top of the tank 1.

According to the invention, a hydraulic drive 5 is mounted on this compact assembly consisting of the tank 1, the motor 2, the pump 3, and the control valve unit 4. This also means, however, that the assembly must absorb the forces of the hydraulic drive 5 and the cab connected to it. The assembly is therefore built with appropriate strength. An advantageous way of doing this is to arrange four support columns 6 in the tank 1 and to attach the columns to a bottom plate 7 of the tank 1 by welding, for example. The columns pass upward through a cover plate 8 at the top of the tank 1 and are connected to a support plate 9 above the cover plate 8.

It is advantageous for the support columns 6 to be L-profiles of steel. It is advantageous for the motor 2 and the pump 3 to be fastened in place inside the tank 1.

A ring 10, which holds the bottom end of the hydraulic drive 5, is welded to the support plate 9 which closes off the support columns 6. This lower end of the hydraulic drive is formed by a piece of tubing 11, through which a hydraulic line 12, indicated in broken line, extends from a stop valve 13, which belongs to the control valve unit 4 and which is advantageously provided with means 14 for remote control, to the bottom of a hydraulic cylinder 15 belonging to the hydraulic drive 5. The piston rod 16, to the head of which a cable cable pulley 17 is attached, emerges at the top end of the cylinder. The hydraulic line 12 can be flexible or rigid; that is, it can be formed either by a pressure-resistant hose or by a rigid pipe.

A bracket 18, to which one end of the cable 19 is attached, is welded to the lateral surface of the hydraulic cylinder 15. The cable 19 is guided over the cable pulley 17 and conducted to the cab (not shown).

It belongs to the essence of the invention that a structural assembly consisting of the tank 1, the motor 2, the pump 3 and also the control valve unit 4 is prefabricated at the manufacturer's factory and is connected to the hydraulic drive 5 at the construction site. Because, according to the invention, this structural assembly is located in the elevator shaft between the guide rails, it is not easily accessible after the elevator has been installed. For this reason, it is essential to the invention that an emergency operating and monitoring device 31, which can be set up at any desired location outside the elevator shaft, can be connected to the control valve unit 4 by means of a measuring line 30.

It is advantageous, as previously mentioned, for the stop valve 13 to be equipped with a controller 14 for remote control. The controller 14 can be of a mechanical nature, such as a pull cable leading to a point outside the elevator shaft, which can be operated by a lever. But it can also be of an electrical nature. For example, the stop valve 13 can be equipped with an electric servomotor. If such controller 14 is provided, as is advantageous, then the stop valve 13 can be operated from the outside before it is necessary to enter the elevator shaft pit for installation or testing work.

Figure 2:
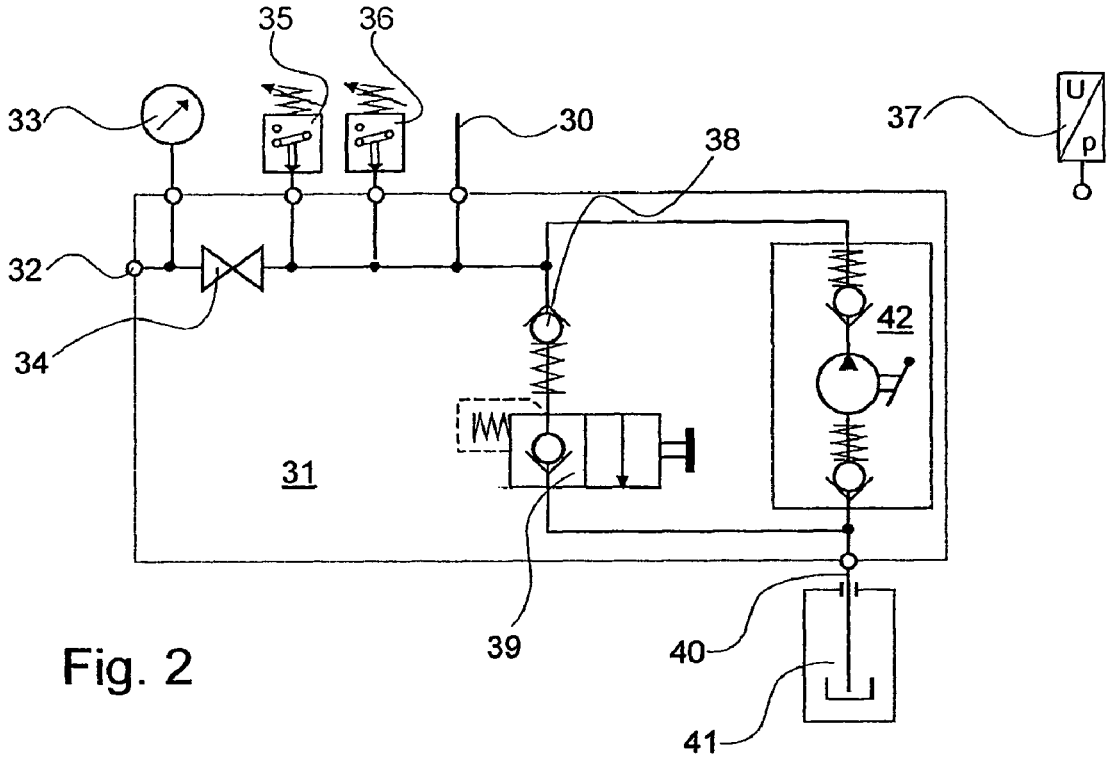
FIG. 2 shows a diagram of an emergency operating and monitoring device.

FIG. 2 shows a first exemplary embodiment of this emergency operating and monitoring device 31 in the form of a detailed schematic diagram. At the top is a connection for the measuring line 30. On the left side, a test connection 32 can be seen, which is designed in accordance with the standard EN 81-2. To the right of that is a manometer 33, as required by the same standard. The line from connection for the measuring line 30 to the test connection 32 and to the manometer 33 can be shut off by a manually operated valve 34.

Two connections, which are connected to the connection for the measuring line 30, are provided on the emergency operating and monitoring device 31. A first pressure switch 35 and a second pressure switch 36 can be connected here. More than two of these connections could also be provided.

The pressure switches 35 and 36, or more if desired, are used to inform the elevator control unit of various load states such as full load or overload, so that, on the basis of the signals transmitted by the pressure switches 35, 36, the elevator control unit can activate safety switching procedures, if necessary. In place of the pressure switches 35, 36, it would be possible to use a pressure transducer 37, by means of which any desired load state of the cab can be detected and evaluated by the elevator control unit.

Also connected to the connection for the measuring line 30 is a spring-loaded check valve 38. The check valve 38 prevents the piston rod of the hydraulic drive 5 (FIG. 1) from sinking, which is necessary when the safety brake of the elevator responds.

On the side of the check valve 38 opposite the measuring line 30, a line leads to an emergency manual drain 39 as prescribed by the standard EN 81-2. The second connection of this drain is connected to a tank line 40, which either leads to an oil tank 41, which, in the case of emergency operation, is able to accept the quantity of oil leaving the hydraulic circuit and which has a capacity of, for example, 5 liters, or goes directly back to the tank 1 (FIG. 1).

A manual pump 42 is also connected to the measuring line 30. The second connection of this pump leads to the tank line 40. Thus, if the power fails, the elevator cab can be moved on an emergency basis in the known manner.

Figure 3:
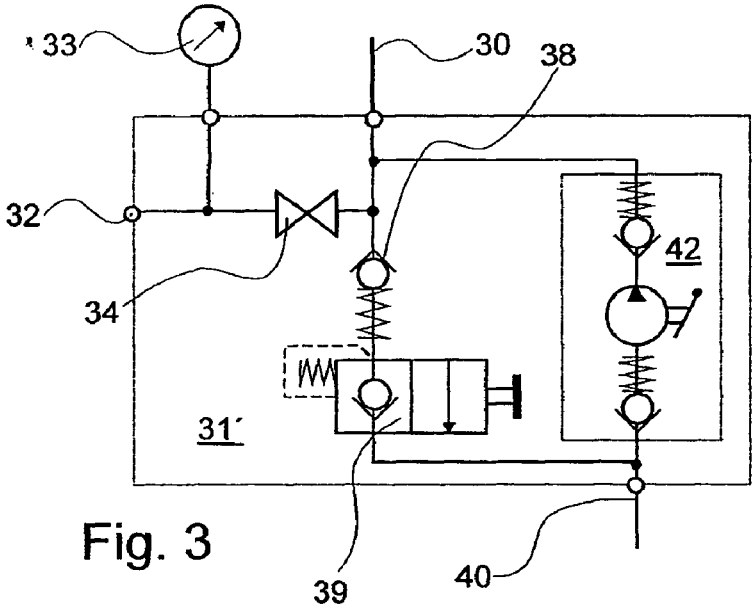
FIG. 3 shows a variant of this device.

FIG. 3 shows a variant of the emergency operating and monitoring device 31, which is identified by the reference number 31'. It is, in principle, exactly the same as the first exemplary embodiment according to FIG. 2, except that here the connections for the pressure switches 35 and 36 or for the pressure transducer 37 are missing. When an emergency operating and monitoring device 31' of this type is used, the pressure switches 35 and 36 or the pressure transducer 37 must be mounted on the control valve unit 4. The emergency operating and monitoring device 31' is then not necessary for the operation of the elevator system and is not even installed on it. An emergency operating and monitoring device 31' of this type is thus one of the tools which the people responsible for service work and/or for the emergency rescue of trapped passengers in the elevator system carry along with them.

Because an emergency operating and monitoring device 31' of this type is not present in every elevator system, and because only one of them is sufficient to cover the needs of a number of individual elevator systems, costs are significantly reduced.

What is claimed is:

1. A hydraulic elevator for an elevator shaft having guide rails for an elevator cab, the hydraulic elevator requiring no machine room and comprising:

a tank;

a pump mounted in the tank;

a motor mounted in the tank for driving the pump; and a control valve unit mounted on the tank and in working relationship with the pump, wherein the pump and the motor are vertically mounted in the tank;

a hydraulic drive mounted on the tank between the guide rails for the elevator cab, the hydraulic drive being configured to move the elevator cab by a cable, the tank supporting the hydraulic drive and elevator cab; and an emergency operating and monitoring device disposed outside of the elevator shaft and connectable to the control valve unit by a measuring line.

2. The hydraulic elevator of claim 1, wherein the tank comprises a bottom plate, a support plate, a cover plate disposed between the bottom plate and the support plate, and a plurality of support columns attached to the bottom plate and the support plate and extending through the cover plate.

3. The hydraulic elevator of claim 2, wherein each of the support columns comprises steel and has a L-shaped cross section.

4. The hydraulic elevator of claim 3, wherein each of the motor and the pump is attached to at least one of the support columns.

5. The hydraulic elevator of claim 1, further comprising two pressure switches connected to the emergency operating and monitoring device or a pressure transducer connected to the emergency operating and monitoring device.

6. The hydraulic elevator of claim 1, further comprising two pressure switches mounted on the control valve unit or a pressure transducer mounted on the control valve unit.

7. The hydraulic elevator of claim 1, wherein the control valve unit comprises a stop valve and a controller by which the stop valve can be remotely operated from outside of the elevator shaft.

8. The hydraulic elevator of claim 7, wherein the controller comprises a pull cable.

9. The hydraulic elevator of claim 7, wherein the controller comprises an electric servomotor.

* * * * *